US008404627B2

(12) United States Patent
Bertram et al.

(10) Patent No.: US 8,404,627 B2
(45) Date of Patent: Mar. 26, 2013

(54) DETERGENT COMPRISING $C_{10}$ TO $C_{40}$ HYDROCARBYL SUBSTITUTED HYDROXYBENZOATES FOR REDUCING ASPHALTENE PRECIPITATION

(75) Inventors: Richard D. Bertram, Witney (GB); Peter J. Dowding, Wantage (GB); Peter D. Watts, Abingdon (GB)

(73) Assignee: Infineum International Limited (GB)

( * ) Notice: Subject to any disclaimer, the term of this patent is extended or adjusted under 35 U.S.C. 154(b) by 63 days.

(21) Appl. No.: 12/557,037

(22) Filed: Sep. 10, 2009

(65) Prior Publication Data

US 2010/0062958 A1 Mar. 11, 2010

(30) Foreign Application Priority Data

Sep. 11, 2008 (EP) ..... 08105318

(51) Int. Cl.
*C11D 7/26* (2006.01)

(52) U.S. Cl. ..... 510/185; 508/502; 508/518; 508/522; 508/583; 508/584; 560/143; 562/473

(58) Field of Classification Search ..... 510/185; 508/502, 518, 522, 583, 584; 562/473; 560/143
See application file for complete search history.

(56) References Cited

U.S. PATENT DOCUMENTS 3,985,687 A * 10/1976 Inamorato et al. ..... 510/325
4,021,359 A * 5/1977 Schwab ..... 510/477
4,719,023 A * 1/1988 MacPhail et al. ..... 508/460
2002/0058593 A1* 5/2002 Bovington et al. ..... 508/192
2002/0142922 A1* 10/2002 Yagishita et al. ..... 508/374
2003/0166481 A1* 9/2003 Smith et al. ..... 510/155
2004/0009882 A1* 1/2004 Elsik et al. ..... 510/108
2004/0186027 A1* 9/2004 Moreton et al. ..... 508/186
2005/0137100 A1* 6/2005 Le Coent et al. ..... 508/518
2006/0063686 A1* 3/2006 Yagishita ..... 508/518
2006/0178278 A1* 8/2006 Kocsis et al. ..... 508/390
2006/0281642 A1* 12/2006 Colbourne et al. ..... 508/192
2007/0027057 A1* 2/2007 Le Coent et al. ..... 510/505
2007/0049508 A1* 3/2007 Stonebraker et al. ..... 508/586
2007/0117726 A1* 5/2007 Cartwright ..... 508/525
2008/0026971 A1* 1/2008 Deckman et al. ..... 508/525
2008/0110799 A1* 5/2008 Matsui et al. ..... 208/19
2008/0248981 A1* 10/2008 Matsui et al. ..... 508/382
2008/0255013 A1* 10/2008 Chambard et al. ..... 508/585
2009/0281009 A1* 11/2009 Van Houten ..... 508/287
2010/0069273 A1* 3/2010 Skinner ..... 508/278
2010/0087347 A1* 4/2010 Bertram et al. ..... 508/460
2010/0099591 A1* 4/2010 Harrold et al. ..... 508/502
2010/0197535 A1* 8/2010 Brossaud et al. ..... 508/154

* cited by examiner

*Primary Examiner* — Charles Boyer

(57) ABSTRACT

A detergent including one or more neutral or overbased alkaline earth metal $C_{10}$ to $C_{40}$ hydrocarbyl substituted hydroxybenzoates, in which:

(i) the one or more neutral or overbased alkaline earth metal $C_{10}$ to $C_{40}$ hydrocarbyl substituted hydroxybenzoates is or includes one or more $C_{10}$ to $C_{40}$ hydrocarb-1-yl substituted hydroxybenzoates; or, (ii) greater than 50 mole % of the one or more neutral or overbased alkaline earth metal $C_{10}$ to $C_{40}$ hydrocarbyl substituted hydroxybenzoates, based on the total number of moles of said $C_{10}$ to $C_{40}$ hydrocarbyl substituted hydroxybenzoates, is or includes one or more $C_{10}$ to $C_{40}$ hydrocarb-2-yl substituted hydroxybenzoates.

24 Claims, No Drawings

DETERGENT COMPRISING $C_{10}$ TO $C_{40}$ HYDROCARBYL SUBSTITUTED HYDROXYBENZOATES FOR REDUCING ASPHALTENE PRECIPITATION

FIELD OF THE INVENTION

This present invention relates to a detergent, in particular a hydrocarbyl substituted hydroxybenzoate detergent, especially a hydrocarbyl substituted salicylate detergent. The present invention also relates to a lubricating oil composition containing such a detergent and the use of such detergents in a lubricating oil composition for reducing asphaltene precipitation which can result in the formation of 'black paint' or 'black sludge' in an engine, in particular, a marine diesel engine.

BACKGROUND OF THE INVENTION

In marine trunk piston engines, Heavy Fuel Oil ('HFO') is generally used for offshore running. Heavy Fuel Oil is the heaviest fraction of petroleum distillate and comprises a complex mixture of molecules including up to 15% of asphaltenes, which are defined as the fraction of petroleum distillate which is insoluble in an excess of aliphatic hydrocarbon (e.g. heptane) but which shows solubility in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer, which can result in cracks forming, which then propagate through the piston. If a crack travels right the way through, then hot combustion gases can enter the crankcase, which may result in a crankcase explosion.

A key design feature of trunk piston engine oils ('TPEO's) is prevention of asphaltene precipitation but, with the current use of Group II base oils which have a lower aromatics content, their effectiveness in this respect has been reduced.

WO 96/26995 discloses the use of a hydrocarbyl-substituted phenol to reduce 'black paint' in a diesel engine. WO 96/26996 discloses the use of a demulsifier for water-in-oil emulsions, for example, a polyoxyalkylene polyol, to reduce 'black paint' in diesel engines.

The aim of the present invention is to reduce asphaltene precipitation or 'black paint' in an engine, in particular, a marine diesel engine. The aim of the present invention is also to reduce asphaltene precipitation or 'black paint' in an engine using a lubricating oil composition comprising a Group II base stock.

SUMMARY OF THE INVENTION

The present invention is based on the discovery that a hydrocarbyl substituted hydroxybenzoate detergent exhibits a superior reduction in asphaltene precipitation, particularly when used in a lubricating oil composition comprising a Group II base stock, when the majority of the hydrocarbyl substituents of the hydroxybenzoate detergent are attached to the hydroxybenzoate ring via the carbon atom at the C-2 position of the hydrocarbyl substituent or when the hydrocarbyl substituted hydroxybenzoate detergent includes hydrocarbyl substituents attached to the hydroxybenzoate ring via the carbon atom at the C-1 position of the hydrocarbyl substituent.

In accordance with a first aspect, the present invention provides a detergent comprising one or more neutral or overbased alkaline earth metal $C_{10}$ to $C_{40}$ hydrocarbyl substituted hydroxybenzoates, wherein:

(i) the one or more neutral or overbased alkaline earth metal $C_{10}$ to $C_{40}$ hydrocarbyl substituted hydroxybenzoates comprises one or more $C_{10}$ to $C_{40}$ hydrocarb-1-yl substituted hydroxybenzoates; or, (ii) greater than 50 mole % of the one or more $C_{10}$ to $C_{40}$ hydrocarbyl substituted hydroxybenzoates, based on the total number of moles of said $C_{10}$ to $C_{40}$ hydrocarbyl substituted hydroxybenzoates, comprises or one or more $C_{10}$ to $C_{40}$ hydrocarb-2-yl substituted hydroxybenzoates.

Preferably, the one or more neutral or overbased alkaline earth metal $C_{10}$ to $C_{40}$ hydrocarbyl substituted hydroxybenzoates comprise, more preferably consists essentially of, one or more neutral or overbased alkaline earth metal $C_{10}$ to $C_{40}$ hydrocarbyl substituted salicylates.

According to a second aspect, the present invention provides a method of manufacturing the detergent according to the first aspect of the invention, the method comprising reacting one or more $C_{10}$ to $C_{40}$ hydrocarbyl substituted hydroxybenzoic acids with a metallic base and optionally with carbon dioxide, wherein:

(i) the one or more $C_{10}$ to $C_{40}$ hydrocarbyl substituted hydroxybenzoic acids comprises one or more $C_{10}$ to $C_{40}$ hydrocarb-1-yl substituted hydroxybenzoic acids; or, (ii) greater than 50 mole % of the one or more $C_{10}$ to $C_{40}$ hydrocarbyl substituted hydroxybenzoic acids, based on the total number of moles of said one or more $C_{10}$ to $C_{40}$ hydrocarbyl substituted hydroxybenzoic acids, comprises one or more $C_{10}$ to $C_{40}$ hydrocarb-2-yl substituted hydroxybenzoic acids.

According to a third aspect, the present invention provides a compound comprising one or more $C_{10}$ to $C_{40}$ hydrocarbyl substituted hydroxybenzoic acids as defined in accordance with the second aspect of the invention.

According to a fourth aspect, the present invention provides a method of manufacturing one or more $C_{10}$ to $C_{40}$ hydrocarbyl substituted hydroxybenzoic acids according to the third aspect of the present invention, the method comprising carboxylating one or more $C_{10}$ to $C_{40}$ hydrocarbyl substituted phenols, wherein:

(i) the one or more $C_{10}$ to $C_{40}$ hydrocarbyl substituted phenols comprises one or more $C_{10}$ to $C_{40}$ hydrocarb-1-yl substituted phenols; or, (ii) greater than 50 mole % of the one or more $C_{10}$ to $C_{40}$ hydrocarbyl substituted phenols, based on the total number of moles of said one or more $C_{10}$ to $C_{40}$ hydrocarbyl substituted phenols, comprises one or more $C_{10}$ to $C_{40}$ hydrocarb-2-yl substituted phenols.

According to a fifth aspect, the present invention provides a compound comprising one or more $C_{10}$ to $C_{40}$ hydrocarbyl substituted phenols as defined in accordance with the fourth aspect of the invention.

According to a sixth aspect, the present invention provides a method of manufacturing one or more $C_{10}$ to $C_{40}$ hydrocarbyl substituted phenols according to the fifth aspect of the invention, the method comprising reacting an organometallic compound that includes a protected phenol carbanion with one or more $C_{10}$ to $C_{40}$ halo-hydrocarbyl compounds to form one or more $C_{10}$ to $C_{40}$ hydrocarbyl substituted protected phenols, and then removing the protecting group from the one or more $C_{10}$ to $C_{40}$ hydrocarbyl substituted protected phenols, wherein the one or more $C_{10}$ to $C_{40}$ halo-hydrocarbyl compounds comprises one or more $C_{10}$ to $C_{40}$ 1-halo-hydrocarbyl compounds or greater than 50 mole % of the one or more $C_{10}$ to $C_{40}$ halo substituted hydrocarbyl compounds, based on the total number of $C_{10}$ to $C_{40}$ halo substituted hydrocarbyl compounds, comprises one or more $C_{10}$ to $C_{40}$ 2-halo-hydrocarbyl compounds.

According to a seventh aspect, the present invention provides a lubricating oil composition comprising, or made by admixing:

(A) an oil of lubricating viscosity; and, (B) a detergent according to the first aspect of the invention.

The lubricating oil composition is preferably a trunk piston engine oil ('TPEO'). The oil of lubricating viscosity preferably comprises a Group II base stock.

According to an eighth aspect, the present invention provides a method of reducing asphaltene precipitation or 'black paint' in an engine, the method including the step of lubricating the engine with a lubricating oil composition according to the seventh aspect of the invention.

According to a ninth aspect, the present invention provides the use of a detergent according to the first aspect of the present invention in an oil of lubricating viscosity to reduce asphaltene precipitation or 'black paint' in an engine.

The engine is preferably a marine diesel engine.

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group;

"hydrocarb-1-yl" means a hydrocarbyl group that is bonded to the remainder of the compound directly via the carbon atom at the C-1 position of the hydrocarbyl group;

"hydrocarb-2-yl" means a hydrocarbyl group that is bonded to the remainder of the compound directly via the carbon atom at the C-2 position of the hydrocarbyl group;

references herein to '% by number of the $C_{10}$ to $C_{40}$ hydrocarbyl substituents' in respect of the one or more neutral or overbased alkaline earth metal $C_{10}$ to $C_{40}$ hydrocarbyl substituted hydroxybenzoates apply equally to the $C_{10}$ to $C_{40}$ hydrocarbyl substituents of the one or more benzoic acids and phenols according to the third and fifth aspects of the invention;

references herein to 'mole %' in respect of the one or more neutral or overbased alkaline earth metal $C_{10}$ to $C_{40}$ hydrocarb-2-yl substituted hydroxybenzoates or one or more neutral or overbased alkaline earth metal $C_{10}$ to $C_{40}$ hydrocarb-1-yl substituted hydroxybenzoates apply equally to the mole % of: the one or more $C_{10}$ to $C_{40}$ hydrocarb-1-yl substituted hydroxybenzoic acids and the one or more $C_{10}$ to $C_{40}$ hydrocarb-2-yl substituted hydroxybenzoic acids, according to the third aspect of the invention; the one or more $C_{10}$ to $C_{40}$ hydrocarb-1-yl substituted phenols and the one or more $C_{10}$ to $C_{40}$ hydrocarb-2-yl substituted phenols according to the fifth aspect of the invention; and, the one or more $C_{10}$ to $C_{40}$ 1-halo-hydrocarbyl compounds and the one or more $C_{10}$ to $C_{40}$ 2-halo-hydrocarbyl compounds employed in the sixth aspect of the invention.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating to each and all aspects of the invention will now be described in more detail as follows:

Hydroxybenzoate Detergent

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

The surfactant of the present invention is a hydrocarbyl substituted hydroxybenzoic acid; preferably a hydrocarbyl substituted salicylic acid. The one or more neutral or overbased alkaline earth metal $C_{10}$ to $C_{40}$ hydrocarbyl substituted hydroxybenzoates typically comprise one or more compounds of Formula I:

I

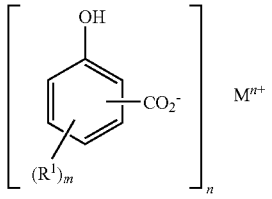

wherein $R^1$ represents a hydrocarbyl group that is predominantly aliphatic in nature having 10 to 40 carbon atoms, M is a alkaline earth metal, n is an integer of 1 or 2 depending on the valence of the metal, m is an integer of 1 to 3, and wherein:

greater than 50 mole % of the one or more neutral or overbased alkaline earth metal $C_{10}$ to $C_{40}$ hydrocarbyl substituted hydroxybenzoates of Formula I, based on the total number of moles of said one or more neutral or overbased alkaline earth metal $C_{10}$ to $C_{40}$ hydrocarbyl substituted hydroxybenzoates, comprises one or more neutral or overbased alkaline earth metal $C_{10}$ to $C_{40}$ hydrocarb-2-yl substituted hydroxybenzoates; or, the one or more neutral or overbased alkaline earth metal $C_{10}$ to $C_{40}$ hydrocarbyl substituted hydroxybenzoates of Formula I comprises one or more neutral or overbased alkaline earth metal $C_{10}$ to $C_{40}$ hydrocarb-1-yl substituted hydroxybenzoates.

Suitably, the mole percentage of the one or more $C_{10}$ to $C_{40}$ hydrocarb-1-yl substituted hydroxybenzoates or one or more $C_{10}$ to $C_{40}$ hydrocarb-2-yl substituted hydroxybenzoates present in the total amount of the one or more neutral or overbased alkaline earth metal $C_{10}$ to $C_{40}$ hydrocarbyl substituted hydroxybenzoates may be determined by standard techniques, such as gas chromatography and nuclear magnetic resonance (NMR) spectroscopy, especially proton NMR.

The alkaline earth metal M of the one or more neutral or overbased alkaline earth metal $C_{10}$ to $C_{40}$ hydrocarbyl substituted hydroxybenzoates of Formula I is an alkaline earth metal such as calcium, magnesium, barium or strontium. Preferably, the alkaline earth metal M of the one or more neutral or overbased metal $C_{10}$ to $C_{40}$ hydrocarbyl substituted hydroxybenzoates is calcium or magnesium; calcium is especially preferred.

Suitably, when the surfactant comprises the preferred hydrocarbyl substituted salicylic acid, the one or more neutral or overbased alkaline earth metal $C_{10}$ to $C_{40}$ hydrocarbyl substituted salicylates typically comprise one or more compounds of Formula II:

II

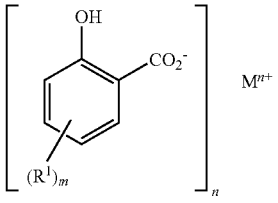

wherein $R^1$, M, n and m are as defined for a compound of formula I and wherein:

greater than 50 mole % of the one or more neutral or overbased alkaline earth metal $C_{10}$ to $C_{40}$ hydrocarbyl substituted salicylates of Formula II, based on the total number of moles of said one or more neutral or overbased alkaline earth metal $C_{10}$ to $C_{40}$ hydrocarbyl substituted salicylates, comprises one or more neutral or overbased alkaline earth metal $C_{10}$ to $C_{40}$ hydrocarb-2-yl substituted hydroxybenzoates; or, the one or more neutral or overbased alkaline earth metal $C_{10}$ to $C_{40}$ hydrocarbyl substituted salicylates of Formula II comprises one or more neutral or overbased alkaline earth metal $C_{10}$ to $C_{40}$ hydrocarb-1-yl substituted salicylates.

For the avoidance of doubt, the preferred features of the $C_{10}$ to $C_{40}$ hydrocarbyl substituted hydroxybenzoates also represent preferred features of the $C_{10}$ to $C_{40}$ hydrocarbyl substituted salicylates and vice versa.

Preferably, the hydrocarbyl group consists solely of carbon and hydrogen atoms. The hydrocarbyl group is predominantly aliphatic in nature and it is preferably purely aliphatic. Purely aliphatic hydrocarbyl groups include linear or branched aliphatic groups, for example linear or branched alkyl or alkenyl groups. Most preferably, the hydrocarbyl group represents a linear (i.e. straight chain) or branched alkyl group, particularly an unsubstituted linear or branched alkyl group, especially an unsubstituted linear alkyl group.

Examples of the $C_{10}$ to $C_{40}$ alkyl groups (which may be linear or branched) include decyl, undecyl, dodecyl, tridecyl, tetradecyl, pentadecyl, hexadecyl, heptadecyl, octadecyl, nonadecyl, eicosyl, heneicosyl, dococyl, tricocyl, tetracocyl, pentacocyl, hexacocyl, heptacocyl, octacocyl, nonacocyl, and triacontyl. Examples of $C_{10}$ to $C_{40}$ alkenyl groups (which may be linear or branched, the position of the double bond being arbitrary) include decenyl, undecenyl, dodecenyl, tridecenyl, tetradecenyl, pentadecenyl, hexadecenyl, heptadecenyl, octadecenyl, nonadecenyl, eicosenyl, heneicosenyl, dococenyl, tricocenyl, tetracocenyl, pentacocenyl, hexacocenyl, heptacocenyl, octacocenyl, nonacocenyl, and triacontenyl.

In accordance with a preferred embodiment of the present invention, greater than 50, preferably greater than or equal to 55, more preferably greater than or equal to 60, even more preferably greater than or equal to 65, even more preferably greater than or equal to 70, mole % of the total number of moles of the one or more neutral or overbased alkaline earth metal $C_{10}$ to $C_{40}$ hydrocarbyl substituted hydroxybenzoates, comprises one or more neutral or overbased alkaline earth metal $C_{10}$ to $C_{40}$ hydrocarb-2-yl substituted hydroxybenzoates. Preferably, the $C_{10}$ to $C_{40}$ hydrocarbyl substituents comprise one or more linear or branched $C_{10}$ to $C_{40}$ alkyl or alkenyl groups as defined herein. More preferably, greater than 50, even more preferably greater than 60, even more preferably greater than 70, even more preferably greater than 80, especially greater than 85, % by number of the $C_{10}$ to $C_{40}$ hydrocarbyl substituents, based on the total number of $C_{10}$ to $C_{40}$ hydrocarbyl substituents, comprise one or more linear or branched $C_{10}$ to $C_{40}$ alkyl or alkenyl groups, preferably a linear (i.e. straight chain) or branched alkyl group, more preferably an unsubstituted linear or branched alkyl group, especially an unsubstituted linear alkyl group. Suitably, when the $C_{10}$ to $C_{40}$ hydrocarbyl substituent represents a linear alkyl group bonded at the C-2 carbon atom to the hydroxybenzoate ring, then the alkyl group is a secondary alkyl group in other words, the carbon atom at the C-2 position of the alkyl group includes a hydrogen atom, a methyl group and a linear alkyl group bonded thereto.

Suitably, greater than or equal to 50%, preferably greater than or equal to 55 %, more preferably greater than or equal to 60%, more preferably greater than or equal to 65%, even more preferably greater than or equal to 70%, by number of said $C_{10}$ to $C_{40}$ hydrocarbyl substituents of the one or more neutral or overbased alkaline earth metal $C_{10}$ to $C_{40}$ hydrocarbyl substituted hydroxybenzoates, based on the total number of $C_{10}$ to $C_{40}$ hydrocarbyl substituents of all of said one or more neutral or overbased alkaline earth metal $C_{10}$ to $C_{40}$ hydrocarbyl substituted hydroxybenzoates, are attached to the one or more hydroxybenzoate rings via the carbon atom at the C-2 position of the hydrocarbyl substituent.

According to an alternative preferred embodiment of the present invention, greater than 10, preferably greater than or equal to 20, more preferably greater than or equal to 30, even more preferably greater than or equal to 40, even more preferably greater than or equal to 50, even more preferably greater than or equal to 60, even more preferably greater than or equal to 65, even more preferably greater than or equal to 70, mole % of the total number of moles of the one or more neutral or overbased alkaline earth metal $C_{10}$ to $C_{40}$ hydrocarbyl substituted hydroxybenzoates, comprises one or more neutral or overbased alkaline earth metal $C_{10}$ to $C_{40}$ hydrocarb-1-yl substituted hydroxybenzoates. Preferably less than or equal to 99, more preferably less than or equal to 95, even more preferably less than or equal to 90, and most preferably less than or equal to 85, mole % of the total number of moles of the one or more neutral or overbased alkaline earth metal $C_{10}$ to $C_{40}$ hydrocarbyl substituted hydroxybenzoates, comprises one or more neutral or overbased alkaline earth metal $C_{10}$ to $C_{40}$ hydrocarb-1-yl substituted hydroxybenzoates. Preferably, the $C_{10}$ to $C_{40}$ hydrocarbyl substituents comprise one or more linear or branched $C_{10}$ to $C_{40}$ alkyl or alkenyl groups as defined herein. More preferably, greater than 50, even more preferably greater than 60, even more preferably greater than 70, even more preferably greater than 80, % by number of the $C_{10}$ to $C_{40}$ hydrocarbyl substituents, based on the total number of $C_{10}$ to $C_{40}$ hydrocarbyl substituents, comprise one or more linear or branched $C_{10}$ to $C_{40}$ alkyl or alkenyl groups, preferably a linear (i.e. straight chain) or branched alkyl group, more preferably an unsubstituted linear or branched alkyl group, especially an unsubstituted linear alkyl group. Preferably, the $C_{10}$ to $C_{40}$ hydrocarbyl substituents comprise one or more linear or branched $C_{10}$ to $C_{40}$ alkyl or alkenyl groups as defined herein. Suitably, when the $C_{10}$ to $C_{40}$ hydrocarbyl substituent represents an alkyl group bonded at the C-1 carbon atom to the hydroxybenzoate ring, then the alkyl group is a primary alkyl group. In other words, the carbon atom at the C-1 position of the alkyl group includes two hydrogen atoms and a single linear alkyl group bonded thereto.

Suitably, greater than or equal to 10%, preferably greater than or equal to 20%, more preferably greater than or equal to 30%, even more preferably greater than or equal to 40%, even more preferably greater than or equal to 50%, even more preferably greater than or equal to 55%, even more preferably greater than or equal to 60%, even more preferably greater than or equal to 65%, even more preferably greater than or equal to 70%, by number of said $C_{10}$ to $C_{40}$ hydrocarbyl substituents of the one or more neutral or overbased alkaline earth metal $C_{10}$ to $C_{40}$ hydrocarbyl substituted hydroxybenzoates, based on the total number of $C_{10}$ to $C_{40}$ hydrocarbyl substituents of all of said one or more neutral or overbased alkaline earth metal $C_{10}$ to $C_{40}$ hydrocarbyl substituted hydroxybenzoates, are attached to the one or more hydroxybenzoate rings via the carbon atom at the C-1 position of the hydrocarbyl substituent.

Suitably, less than or equal to 99%, more preferably less than or equal to 95%, even more preferably less than or equal to 90%, and most preferably less than or equal to 85%, by number of said $C_{10}$ to $C_{40}$ hydrocarbyl substituents of the one or more neutral or overbased alkaline earth metal $C_{10}$ to $C_{40}$ hydrocarbyl substituted hydroxybenzoates, based on the total number of $C_{10}$ to $C_{40}$ hydrocarbyl substituents of all of said one or more neutral or overbased alkaline earth metal $C_{10}$ to $C_{40}$ hydrocarbyl substituted hydroxybenzoates, are attached to the one or more hydroxybenzoate rings via the carbon atom at the C-1 position of the hydrocarbyl substituent.

Suitably, by the terms '$C_{10}$ to $C_{40}$ hydrocarb-2-yl substituted hydroxybenzoates' and '$C_{10}$ to $C_{40}$ hydrocarb-1-yl substituted hydroxybenzoates' we mean the $C_{10}$ to $C_{40}$ hydrocarbyl substitutent is attached to the respective hydroxybenzoate rings via the carbon atom at the C-2 position or C-1 position of the hydrocarbyl substituent, respectively.

Suitably, greater than 50% by number, more preferably greater than or equal to 55%, even more preferably greater than or equal to 60%, even more preferably greater than or equal to 65%, even more preferably greater than or equal to 70%, by number, of the $C_{10}$ to $C_{40}$ hydrocarbyl substituents of each of said one or more neutral or overbased alkaline earth metal $C_{10}$ to $C_{40}$ hydrocarbyl substituted hydroxybenzoates, based on the total number of $C_{10}$ to $C_{40}$ hydrocarbyl substituents of each of said one or more neutral or overbased alkaline earth metal $C_{10}$ to $C_{40}$ hydrocarbyl substituted hydroxybenzoates, are attached to the hydroxybenzoate ring via the carbon atom at the C-2 position or C-1 position of the hydrocarbyl substituent, or a combination thereof.

According to a preferred embodiment of the present invention, the $C_{10}$ to $C_{40}$ hydrocarbyl substituents comprise $C_{10}$ to $C_{20}$ hydrocarbyl groups, preferably $C_{14}$ to $C_{18}$ hydrocarbyl groups, especially $C_{14}$, $C_{16}$ and $C_{18}$ hydrocarbyl groups or mixtures thereof. Preferably, greater than 50, more preferably greater than 60, even more preferably greater than 70, even more preferably greater than 80, even more preferably greater than 90, mole % of the one or more neutral or overbased alkaline earth metal $C_{10}$ to $C_{40}$ hydrocarbyl substituted hydroxybenzoates, based on the total number of moles of the one or more neutral or overbased alkaline earth metal $C_{10}$ to $C_{40}$ hydrocarbyl substituted hydroxybenzoates, most preferably essentially all of the one or more neutral or overbased alkaline earth metal $C_{10}$ to $C_{40}$ hydrocarbyl substituted hydroxybenzoates, comprises one or more neutral or overbased alkaline earth metal $C_{10}$ to $C_{20}$ hydrocarbyl, preferably $C_{14}$ to $C_{18}$ hydrocarbyl, especially $C_{14}$, $C_{16}$ and $C_{18}$ hydrocarbyl, substituted hydroxybenzoates.

According to an alternative preferred embodiment of the present invention, the $C_{10}$ to $C_{40}$ hydrocarbyl substituents comprise $C_{20}$ to $C_{30}$ hydrocarbyl groups, preferably $C_{20}$ to $C_{24}$ hydrocarbyl groups, especially $C_{20}$, $C_{22}$ and $C_{24}$ hydrocarbyl groups or mixtures thereof. Preferably, greater than 50, more preferably greater than 60, even more preferably greater than 70, even more preferably greater than 80, even more preferably greater than 90, mole % of the one or more neutral or overbased alkaline earth metal $C_{10}$ to $C_{40}$ hydrocarbyl substituted hydroxybenzoates, based on the total number of moles of the one or more neutral or overbased alkaline earth metal $C_{10}$ to $C_{40}$ hydrocarbyl substituted hydroxybenzoates, most preferably essentially all of the one or more neutral or overbased alkaline earth metal $C_{10}$ to $C_{40}$ hydrocarbyl substituted hydroxybenzoates, comprises one or more neutral or overbased alkaline earth metal $C_{20}$ to $C_{30}$ hydrocarbyl, preferably $C_{20}$ to $C_{24}$ hydrocarbyl, especially $C_{20}$, $C_{22}$ and $C_{24}$ hydrocarbyl, substituted hydroxybenzoates.

Preferably, the one or more neutral or overbased alkaline earth metal $C_{10}$ to $C_{40}$ hydrocarbyl substituted hydroxybenzoates include less than 5 mole %, more preferably no, hydrocarbyl substituents having less than or equal to 9 carbon atoms and/or having greater than or equal to 41 carbon atoms.

The $C_{10}$ to $C_{40}$ hydrocarbyl group which $R^1$ represents in a compound of Formula I and Formula II may be in the ortho, meta and/or para position with respect to the hydroxyl group. Preferably, the $C_{10}$ to $C_{40}$ hydrocarbyl group in a compound of Formula I and Formula II is in the ortho and/or para position with respect to the hydroxyl group. When the $C_{10}$ to $C_{40}$ hydrocarbyl group is in the ortho position with respect to the hydroxyl group in a compound of Formula II this represents a neutral or overbased alkaline earth metal 3-subsituted $C_{10}$ to $C_{40}$ hydrocarbyl salicylate; when the $C_{10}$ to $C_{40}$ hydrocarbyl group is in the para position with respect to the hydroxyl group in a compound of Formula II this represents a neutral or overbased alkaline earth metal 5-substituted $C_{10}$ to $C_{40}$ hydrocarbyl salicylate.

Preferably, the one or more neutral or overbased alkaline earth metal $C_{10}$ to $C_{40}$ hydrocarbyl substituted hydroxybenzoates comprises one or more neutral or overbased alkaline earth metal mono-substituted $C_{10}$ to $C_{40}$ hydrocarbyl hydroxybenzoates, i.e. m represents 1 in a compound of Formula I and Formula II. More preferably, the one or more neutral or overbased alkaline earth metal $C_{10}$ to $C_{40}$ hydrocarbyl substituted hydroxybenzoates comprises one or more 3-mono-substituted $C_{10}$ to $C_{40}$ hydrocarbyl salicylates, one or more 5-mono-substituted $C_{10}$ to $C_{40}$ hydrocarbyl salicylates, or a mixture thereof.

Suitably, the one or more $C_{10}$ to $C_{40}$ hydrocarb-1-yl substituted hydroxybenzoates comprises one or more mono-substituted $C_{10}$ to $C_{40}$ hydrocarb-1-yl hydroxybenzoates, especially one or more 3-mono-substituted $C_{10}$ to $C_{40}$ hydrocarb-1-yl salicylates, one or more 5-mono-substituted $C_{10}$ to $C_{40}$ hydrocarb-1-yl salicylates, or a mixture thereof.

Suitably, the one or more $C_{10}$ to $C_{40}$ hydrocarb-2-yl substituted hydroxybenzoates comprises one or more mono-substituted $C_{10}$ to $C_{40}$ hydrocarb-2-yl hydroxybenzoates, especially one or more 3-mono-substituted $C_{10}$ to $C_{40}$ hydrocarb-2-yl salicylates, one or more 5-mono-substituted $C_{10}$ to $C_{40}$ hydrocarb-2-yl salicylates, or a mixture thereof.

Preferably, the one or more neutral or overbased alkaline earth metal $C_{10}$ to $C_{40}$ hydrocarbyl substituted hydroxybenzoates comprises greater than 65, more preferably greater than 70, even more preferably greater than 80, even more preferably greater than 85, most preferably greater than 90, mole %, based on the total number of moles of the one or more neutral or overbased alkaline earth metal $C_{10}$ to $C_{40}$ hydrocarbyl substituted hydroxybenzoates, of one or more neutral or overbased alkaline earth metal mono-substituted $C_{10}$ to $C_{40}$ hydrocarbyl hydroxybenzoates, preferably one or more neutral or overbased alkaline earth metal mono-substituted $C_{10}$ to $C_{40}$ hydrocarbyl salicylates, more preferably one or more neutral or overbased alkaline earth metal mono-substituted $C_{10}$ to $C_{40}$ hydrocarbyl salicylates comprising a mixture of the one or more 3-mono-substituted $C_{10}$ to $C_{40}$ hydrocarbyl salicylates and one or more 5-mono-substituted $C_{10}$ to $C_{40}$ hydrocarbyl salicylates.

Suitably, the one or more $C_{10}$ to $C_{40}$ hydrocarb-1-yl substituted hydroxybenzoates comprises greater than 65, more preferably greater than 70, even more preferably greater than 80, even more preferably greater than 85, most preferably greater than 90, mole %, based on the total number of moles of the one or more $C_{10}$ to $C_{40}$ hydrocarb-1-yl substituted hydroxybenzoates, of one or more mono-substituted $C_{10}$ to $C_{40}$ hydrocarb-1-yl hydroxybenzoates, preferably one or more mono-substituted $C_{10}$ to $C_{40}$ hydrocarb-1-yl salicylates, more preferably one or more mono-substituted $C_{10}$ to $C_{40}$ hydrocarb-1-yl salicylates comprising a mixture of the one or more 3-mono-substituted $C_{10}$ to $C_{40}$ hydrocarb-1-yl salicylates and one or more 5-mono-substituted $C_{10}$ to $C_{40}$ hydrocarb-1-yl salicylates.

Suitably, the one or more $C_{10}$ to $C_{40}$ hydrocarb-2-yl substituted hydroxybenzoates comprises greater than 65, more preferably greater than 70, even more preferably greater than 80, even more preferably greater than 85, most preferably greater than 90, mole %, based on the total number of moles of the one or more $C_{10}$ to $C_{40}$ hydrocarb-2-yl substituted hydroxybenzoates, of one or more mono-substituted $C_{10}$ to $C_{40}$ hydrocarb-2-yl hydroxybenzoates, preferably one or more mono-substituted $C_{10}$ to $C_{40}$ hydrocarb-2-yl salicylates, more preferably one or more mono-substituted $C_{10}$ to $C_{40}$ hydrocarb-2-yl salicylates comprising a mixture of the one or more 3-mono-substituted $C_{10}$ to $C_{40}$ hydrocarb-2-yl salicylates and one or more 5-mono-substituted $C_{10}$ to $C_{40}$ hydrocarb-2-yl salicylates.

Preferably, the molar ratio of the one or more 3-mono-substituted $C_{10}$ to $C_{40}$ hydrocarbyl salicylates to the one or more 5-mono-subsituted $C_{10}$ to $C_{40}$ hydrocarbyl salicylates present in the one or more neutral or overbased alkaline earth metal $C_{10}$ to $C_{40}$ hydrocarbyl substituted hydroxybenzoates is greater than or equal to 1.2, more preferably greater than or equal to 1.5, even more preferably greater than or equal to 1.8, even more preferably greater than or equal to 2.0.

Preferably, the one or more neutral or overbased alkaline earth metal $C_{10}$ to $C_{40}$ hydrocarbyl substituted hydroxybenzoates (i.e. one or more neutral or overbased alkaline earth metal $C_{10}$ to $C_{40}$ hydrocarbyl substituted salicylates) comprises, preferably consists essentially of, one or more neutral or low based alkaline earth metal $C_{10}$ to $C_{40}$ hydrocarbyl substituted hydroxybenzoates (i.e. one or more neutral or overbased alkaline earth metal $C_{10}$ to $C_{40}$ hydrocarbyl substituted salicylates). The term "overbased" is generally used to describe metal detergents in which the ratio of the number of equivalents of the metal moiety to the number of equivalents of the acid moiety is greater than one. Suitably, the term "neutral" is generally used to describe metal detergents in which the ratio of the number of equivalents of the metal moiety to the number of equivalents of the acid moiety is equal to one. The term "low based" is typically used to describe metal detergents in which the equivalent ratio of metal moiety to acid moiety is greater than 1 and up to about 2. Preferably, the one or more neutral or overbased alkaline earth metal $C_{10}$ to $C_{40}$ substituted hydroxybenzoates (i.e. one or more neutral or overbased alkaline earth metal $C_{10}$ to $C_{40}$ substituted salicylates) is neutral.

Suitably, the term "one or more neutral or overbased calcium $C_{10}$ to $C_{40}$ substituted hydroxybenzoates" is meant a neutral or overbased detergent in which the alkaline earth metal cations of the oil-insoluble alkaline earth metal salt are essentially calcium cations. Small amounts of other cations may be present in the oil-insoluble alkaline earth metal salt, but typically at least 80, more typically at least 90, for example at least 95, mole %, of the cations in the oil-insoluble alkaline earth metal salt, are calcium ions. Cations other than calcium may be derived, for example, from the use in the manufacture of the overbased detergent of a surfactant salt in which the cation is an alkaline earth metal other than calcium.

Carbonated overbased alkaline earth metal detergents typically comprise amorphous nanoparticles. Additionally, there are disclosures of nanoparticulate materials comprising carbonate in the crystalline calcite and vaterite forms.

The basicity of detergents is preferably expressed as a total base number (TBN). A total base number is the amount of acid needed to neutralise all of the basicity of the material. The TBN may be measured using ASTM standard D2896 or an equivalent procedure. The one or more neutral or overbased alkaline earth metal $C_{10}$ to $C_{40}$ hydrocarbyl substituted hydroxybenzoates, may have a low TBN (i.e. a TBN of less than 50), a medium TBN (i.e. a TBN of 50 to 150) or a high TBN (i.e. a TBN of greater than 150 e.g. 150 to 500). Preferably, the one or more neutral or overbased alkaline earth metal $C_{10}$ to $C_{40}$ hydrocarbyl substituted hydroxybenzoates have a TBN up to 150, preferably 50 to 150. Suitably, the $C_{10}$ to $C_{40}$ hydrocarbyl substituted hydroxybenzoate detergent comprises a low based or neutral detergent system.

The basicity index of the one or more neutral or overbased alkaline earth metal $C_{10}$ to $C_{40}$ hydrocarbyl substituted hydroxybenzoates is preferably greater than 1.0 and preferably less than 1.5.

By "basicity index" we mean the molar ratio of total base to total soap in a neutral or overbased detergent. A neutral detergent has a basicity index of 1.0, whereas a low based detergent has a basicity index of greater than 1, and preferably less than 1.5.

Although a lubricating composition may include other metal detergents apart from the hydroxybenzoate detergent of the present invention, for example metal phenate detergents, preferably the hydroxybenzoate detergent is the predominant detergent in the lubricating oil composition. In other words, the hydroxybenzoate detergent contributes greater than 50%, preferably greater than 60%, more preferably greater than 70%, even more preferably greater than 80%, most preferably 90% of the total TBN to the lubricating oil composition. In a preferred embodiment, the hydroxybenzoate detergent is essentially the sole metal detergent system of the lubricating oil composition.

Hydroxybenzoic acids, particularly salicylic acids, are typically prepared by the carboxylation, by the Kolbe-Schmitt process, of phenoxides, and in that case, will generally be obtained (normally in a diluent) in admixture with uncarboxylated phenol. Salicylic acids may be non-sulphurized or sulphurized, and may be chemically modified and/or contain additional substituents. Processes for sulphurizing a hydrocarbyl-substituted salicylic acid are well known to those skilled in the art, and are described, for example, in US 2007/0027057.

Suitably, the one or more $C_{10}$ to $C_{40}$ hydrocarbyl substituted hydroxybenzoic acids may be formed by the carboxylation of the corresponding one or more $C_{10}$ to $C_{40}$ hydrocarbyl substituted phenols. Typically, this process can be accomplished by treating the one or more $C_{10}$ to $C_{40}$ hydrocarbyl substituted phenols with a base to form the corresponding phenoxides, and then treating the phenoxides with carbon dioxide at an elevated pressure and temperature.

Suitably, the one or more $C_{10}$ to $C_{40}$ hydrocarbyl substituted phenols may be formed by reacting an organometallic compound comprising a protected phenol carbanion, such as Grignard Reagent or organolithium reagent (e.g. (4-methoxyphenyl)magnesium bromide), with greater than 50 mole % of one or more $C_{10}$ to $C_{40}$ 2-halo-hydrocarbyl compounds or with the appropriate mole % of one or more $C_{10}$ to $C_{40}$ 1-halo-hydrocarbyl compounds (e.g. 1-halo- or 2-halo-alkane), respectively, followed by deprotection of the resultant protected hydrocarbyl substituted phenolic compound.

In general, neutral alkaline earth metal hydrocarbyl-substituted salicylates can be prepared by neutralisation of hydrocarbyl-substituted salicylic acid with an equivalent quantity of metallic base. However, a preferred method of preparing a neutral calcium salt of salicylic acid is through double decomposition of methanolic solutions of calcium chloride and sodium hydroxide in the presence of hydrocarbyl-substituted salicylic acid, followed by removal of solids and process solvents.

Overbased alkaline earth metal hydrocarbyl-substituted salicylates can be prepared by any of the techniques employed in the art. A general method is as follows:

1. Neutralisation of hydrocarbyl-substituted salicylic acid with molar excess of metallic base to produce a slightly overbased alkaline earth metal hydrocarbyl-substituted salicylate complex, in a solvent mixture consisting of a volatile hydrocarbon, an alcohol and water;
2. Optionally, carbonation to produce colloidally dispersed alkaline earth metal carbonate followed by post-reaction period;
3. Removal of residual solids that are not colloidally dispersed; and
4. Stripping to remove process solvents.

Overbased alkaline earth metal hydrocarbyl-substituted salicylates can be made by either a batch or a continuous overbasing process.

To obtain a neutral or overbased alkaline earth metal hydrocarbyl-substituted salicylate detergent having a basicity index of less than 2, the quantity of metallic base is restricted to no more than 2 equivalents per equivalent of acid, and/or, if desired, the quantity of carbon dioxide is restricted to no more than 0.5 equivalents per equivalent of acid. Preferably, the quantity of metallic base is restricted to no more than 1.5 equivalents per equivalent of acid, and/or, if desired, the quantity of carbon dioxide is restricted to no more than 0.2 equivalents per equivalent of acid. More preferably, the quantity of metallic base is restricted to no more than 1.4 equivalents per equivalent of acid.

Alternatively, an excess of both metallic base and carbon dioxide can be used, provided that unreacted solids are removed before the carbonation step. In this case the basicity index will not exceed about 1.5. If an overbased alkaline earth metal hydrocarbyl-substituted salicylate detergent having a basicity index of less than 1.5 is required, it is not essential to use any carbon dioxide, but it is preferred. However, most preferably the alkaline earth metal hydrocarbyl-substituted salicylate detergent has a basicity index of less than or equal to 1.5.

As carbonation proceeds, dissolved hydroxide is converted into colloidal carbonate particles dispersed in the mixture of volatile hydrocarbon solvent and non-volatile hydrocarbon oil.

Carbonation may be effected over a range of temperatures up to the reflux temperature of the alcohol promoters.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 cSt at 38° C. are very suitable.

After the reaction with metallic base, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after carbonation and solvent removal.

The products are generally used as an oil solution. If there is insufficient oil present in the reaction mixture to retain an oil solution after removal of the volatiles, further oil should be added. This may occur before, or at an intermediate point, or after solvent removal. Suitably, the detergent includes an oil of lubricating viscosity as defined herein.

Additional materials may form an integral part of an overbased metal detergent. These may, for example, include long chain aliphatic mono- or di-carboxylic acids. Suitable carboxylic acids included stearic and oleic acids, and polyisobutylene (PIB) succinic acids.

Oil of Lubricating Viscosity

This, sometimes referred to as the base oil or base stock, is the primary liquid constituent of the lubricating oil composition of the invention into which the hydroxybenzoate detergent, and optionally other co-additives, and possibly other oils are blended.

The lubricating oils may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Preferably, the oil of lubricating viscosity comprises a Group II base stock.

Suitably, the oil of lubricating viscosity comprises greater than or equal to 10 mass %, more preferably greater than or equal to 20 mass %, even more preferably greater than or equal to 25 mass %, even more preferably greater than or equal to 30 mass %, even more preferably greater than or equal to 40 mass %, even more preferably greater than or equal to 45 mass % of a Group II base stock, based on the total mass of the oil of lubricating viscosity. Most preferably, the oil of lubricating viscosity consists essentially of a Group II base stock, that is the oil of lubricating viscosity comprises greater than 50 mass %, preferably greater than or equal to 60 mass %, more preferably greater than or equal to 70 mass %, even more preferably greater than or equal to 80 mass %, even more preferably greater than or equal to 90 mass % of a Group II base stock, based on the total mass of the oil of lubricating viscosity. The Group II base stock may be the sole oil of lubricating viscosity in the lubricating oil composition.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils which include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils. Synthetic lubricating oils which include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may also comprise a Group I, Group III, Group IV or Group V base stocks or base oil blends of the aforementioned base stocks. Preferably, the oil of lubricating viscosity includes a Group III, Group IV or Group V base stock, or a mixture thereof, in addition to the Group II base stock. Preferably, the volatility of the oil of lubricating viscosity or oil blend, as measured by the NOACK test (ASTM D5880), is less than or equal to 13.5%, preferably less than or equal to 12%, more preferably less than or equal to 10%, most preferably less than or equal to 8%. Suitably, when the oil of lubricating viscosity includes a Group III, Group IV or Group V base stock, or a mixture thereof, in addition to the Group II base stock, the viscosity index (VI) of the oil of lubricating viscosity is at least 120, preferably at least 125, most preferably from about 130 to 140.

A base oil is useful for making concentrates as well as for making lubricating oil compositions. When the oil of lubricating viscosity is used to make a concentrate, it is present in a concentrate-forming amount (e.g., from 30 to 70, such as 40 to 60, mass %) to give a concentrate containing for example 1 to 90, such as 10 to 80, preferably 20 to 80, more preferably 20 to 70, mass % active ingredient of an additive or additives, being the hydroxybenzoate detergent according to the first aspect of the invention, optionally with one or more co-additives. The oil of lubricating viscosity used in a concentrate is a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Suitably, when the oil of lubricating viscosity is used to make a concentrate, the one or more neutral or overbased alkaline earth metal $C_{10}$ to $C_{40}$ hydrocarbyl substituted hydroxybenzoates are present in an amount of 5 to 50, preferably 5 to 40, mass % based on the total mass of the concentrate.

Concentrates constitute a convenient means of handling additives before their use, as well as facilitating solution or dispersion of additives in lubricating oil compositions. When preparing a lubricating oil composition that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

In the present invention, the oil of lubricating viscosity may be provided in a major amount, in combination with a minor amount of the hydroxybenzoate detergent according to the first aspect of the invention and, if necessary, one or more co-additives, such as described hereinafter, constituting a lubricating oil composition. This preparation may be accomplished by adding the hydroxybenzoate detergent directly to the oil or by adding it in the form of a concentrate thereof to disperse or dissolve the additive. Additives may be added to the oil by any method known to those skilled in the art, either before, at the same time as, or after addition of other additives.

Suitably, when the oil of lubricating viscosity is present in a major amount, the one or more neutral or overbased alkaline earth metal $C_{10}$ to $C_{40}$ hydrocarbyl substituted hydroxybenzoates are present in an amount of 0.5 to 10 mass % active ingredient.

Suitably, when the oil of lubricating viscosity is present in a major amount, it is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil composition may be used to lubricate mechanical engine components, particularly marine cylinder and trunk piston engines.

The lubricating oil compositions of the invention (and also concentrates) comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

Co-Additives

The lubricating oil composition may include at least one other co-additive, in addition to the salicylate detergent system (b), selected from friction modifiers, antiwear agents, dispersants, oxidation inhibitors, viscosity modifiers, pour point depressants, rust inhibitors, corrosion inhibitors, demulsifying components and foam control agents. Suitably, such one or more co-additives are present in a minor amount of the lubricating oil composition. Preferably, the one or more co-additives are present in an amount of 5 to 25, more preferably 5 to 18, typically 7 to 15, mass % active ingredient of the lubricating oil composition.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Other detergents, apart from the salicylate detergent system, which may be present in the lubricating oil composition include neutral and overbased metal salts of oil-soluble sulfonates, phenates, sulfurized phenates, thiophosphonates, naphthenates and other oil-soluble carboxylates of a metal, particularly the alkali or alkaline earth metals, e.g. sodium, potassium, lithium, calcium and magnesium. The most commonly used metals are calcium and magnesium, which may both be present in detergents used in a lubricant, and mixtures of calcium and/or magnesium with sodium.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Examples of ashless anti-wear agents include 1,2,3-triazoles, benzotriazoles, thiadiazoles, sulfurised fatty acid esters, and dithiocarbamate derivatives.

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from about 0.08 to about 0.25 mass %, preferably from about 0.09 to about 0.18 mass %, more preferably from about 0.10 to about 0.15 mass %, of nitrogen into the composition.

Oxidation inhibitors or antioxidants increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, secondary aromatic amines, and organocopper salts); hydroperoxide decomposers (e.g., organosulphur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulphur-containing antioxidants, aromatic amine-containing antioxidants, hindered phenolic antioxidants, dithiophosphates derivatives, metal thiocarbamates, and molybdenum-containing compounds. The amount of any such oil-soluble aromatic amine-containing antioxidant should preferably not exceed 0.4 wt. % active ingredient.

Viscosity modifiers (VM) or viscosity index improvers impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

A small amount of a demulsifying component may be used. A preferred demulsifying component is described in EP 0,330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam control can be provided by many compounds including an antifoamant of the polysiloxane type, for example, silicone oil or polydimethyl siloxane.

It may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term mass percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in the lubricating oil composition comprising an oil of lubricating viscosity in a major amount, are listed below. All the values listed are stated as mass percent active ingredient.

| ADDITIVE | MASS % (Broad) | MASS % (Preferred) |
|---|---|---|
| Ashless Dispersant | 0.1-20 | 1-8 |
| Metal Detergents | 0.1-6 | 0.2-4 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-1.5 |
| Pour Point Depressant | 0.01-5 | 0.01-1.5 |
| Antifoaming Agent | 0-5 | 0.001-0.15 |
| Supplemental Antiwear Agents | 0-0.5 | 0-0.2 |
| Friction Modifier | 0-5 | 0-1.5 |
| Viscosity Modifier | 0-6 | 0.01-4 |
| Base stock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Marine Cylinder Lubricants

A marine cylinder lubricating oil formulation may employ from 10 to 35 mass %, preferably 13 to 30 mass %, and most preferably about 16 to 24 mass % of the concentrate or additive package with the remainder being base stock. Preferably, marine cylinder lubricating oil compositions have a compositional TBN (using ASTM D2896) of about 40 to 100, such as between 50 and 90.

Trunk Piston Engine Oils

A trunk piston engine oils may employ from 7 to 35 mass %, preferably 10 to 28 mass %, and most preferably about 12 to 24 mass % of the concentrate or additive package with the remainder being base stock. Preferably, the trunk piston engine oils have a compositional TBN (using ASTM D2896) of about 20 to 60, such as between 25 and 55.

EXAMPLES

The present invention is illustrated by but in no way limited to the following examples.

Example 1

Preparation of 1-methoxy-4-(hexadec-1-yl)benzene 1-bromohexadecane (96.32 g) was transferred into a thoroughly dried 2 litre 3-neck flask, followed by $Li_2CuCl_4$ (0.1M in THF, 31.7 ml). The reaction flask was placed in an ice/water bath. The Grignard reagent (4-methoxyphenyl)magnesium bromide (0.5M in THF, 948 ml) was added dropwise over two days, stopping the reaction overnight. The contents of the reaction flask were mixed with toluene (300 ml) and poured into a separating funnel. 10% HCl solution was then added to acidify the mixture. Water (500 ml) was added and shaken with the toluene. The aqueous layer was washed with toluene (2×300 ml). The organic extracts were combined and washed with water (500 ml) and brine (50 ml) and then dried with $MgSO_4$. The solvent was removed in vacuo to give the title compound as an off-white solid 108.86 g which was characterised by NMR.

Example 2

Preparation of 4-(hexadec-1-yl)phenol

The alkyl anisole of Example 1 (40 g) was transferred to a dry 3-neck 1-litre flask under nitrogen. To this was added tributylhexadecylphosphonium bromide (12.69 g) and HBr (48% aq., 71.4 ml). The resulting thick suspension was warmed to 135° C. and stirred for five hours. Toluene was added and the reaction was transferred to a separating funnel. The organic layer was shaken with water and then the aqueous extract shaken with fresh toluene. The organic extracts were combined and dried with $MgSO_4$. The solvent was removed in vacuo to give the title compound as a brown solid.

Example 3

Preparation of 2-hydroxy-5-(hexadec-1-yl)benzoic acid 3.1 Phenation Step

The alkyl phenol of Example 2 (52.6 g) was weighed into a 3 litre 3-necked boiling flask and xylene (1000 ml) added using a measuring funnel. The flask was set up for distillation and nitrogen was blanketed over the mixture at 400 $ml.min^{-1}$. Stirring was then started at approx. 400 rpm and the mixture heated with an oil bath set to 120° C. and an aqueous sodium hydroxide solution (50%, 9.53 g) was added dropwise. The temperature was raised to 160° C. and all the water removed using a Dean and Stark apparatus. After 4 hours the reaction was cooled to room temperature and left overnight.

3.2 Carboxylation Step

After cooling, the contents of the flask from step 3.1 above were transferred to a 2 litre autoclave. A 1 barg nitrogen gas cap was applied, stirring was started and increased to 550 rpm and the autoclave was heated to 138° C. When the autoclave reached 138° C., $CO_2$ was added, the pressure was increased to approx. 20 barg and held at that temperature and pressure for 5.5 hours. After which heating and stirring were discontinued and the autoclave allowed to cool under pressure overnight. The following day the pressure in the autoclave was reduced to 1 barg and the mixture was collected and transferred to a 5 litre 3-necked reaction vessel. The acid value of the reaction mixture was measured by titration to determine the NaOH charge for the second phenation.

3.3 Rephenation Step

The resulting product of the carboxylation step 3.2 (678.2 g) was charged into a 5 litre 3-necked boiling flask and xylene (1000 ml) added. The flask was set up for distillation and nitrogen was blanketed over the mixture at 400 $ml.min^{-1}$. Stirring was then started at approx. 400 rpm and the mixture heated with an oil bath set to 100° C. Once at that temperature a vacuum was applied and increased until the xylene began to distil. Sodium hydroxide solution (50%, 8.00 g) was added dropwise. After which, the vacuum was increased to give a steady distillation to remove approximately 200 ml of xylene and water. The mixture was allowed to cool under nitrogen overnight. The following day the mixture was heated to 100° C. under nitrogen, a vacuum applied and 20 ml of xylene removed by distillation. The mixture was allowed to cool to 80° C. and then transferred to a 2 litre autoclave.

3.4 Recarboxylation and Acidification Step

The contents of the flask from the rephenation step 3.3 were transferred to a 2 litre autoclave. A 1 barg nitrogen gas cap was applied, stirring was started and increased to 550 rpm and the autoclave was heated to 138° C. When the autoclave reached 138° C., $CO_2$ was added, the pressure was increased to approx. 20 barg and held at temperature and pressure for 5.5 hours. After which, stirring and heating were stopped and the autoclave was turned off and left under pressure overnight.

The following day the pressure in the autoclave was reduced to approx. 1 barg and the contents were transferred to a 5 litre 3-necked boiling flask set up for reflux. Nitrogen was blanketed over the mixture at 400 ml/min, the mixture was stirred at 300 rpm and heated in an oil bath at 60° C. Sulphuric acid (300 ml of 14% (v/v)) was added to the mixture from a dropping funnel. After addition of the acid the mixture was left stirring for 2 hours. The heat and stirring were then turned off and the mixture cooled and allowed to separate. After 30 minutes the mixture was transferred into a separating funnel and the acid layer was run off and discarded. The xylene layer was put back into the reaction flask and 250 ml of de-ionised water was added. The mixture was stirred at approximately 450 rpm and heated in an oil bath at 60° C. The mixture was stirred at this temperature for 1 hour, cooled to room temperature and the xylene layer collected. The xylene layer was run back into the reaction vessel and washed in the same manner with a further 250 ml of de-ionised water, the xylene layer was again collected and the solvent removed in vacuo to yield the title compound (38.8 g).

Example 4

Preparation of Low Base Calcium 5-(hexadec-1-yl)salicylate

The 5-(hexadec-1-yl)salicylic acid of Example 3 (3.16 g) was mixed with a commercial lower alkyl (i.e. less than $C_{20}$) salicylic acid (Infineum M7103, obtainable from Infineum UK Limited, 3.89 g), and 4-(hexadec-1-yl)phenol of Example 2 (0.34 g). The salicylic acid mixture and xylene (100 g) were mixed together at room temperature. Calcium hydroxide (2.50 g), a promoter (methanol:water (97%:3%), 25.29 ml) and further xylene (120 g) were added, nitrogen passed through the mixture (60 $ml.min^{-1}$) and the resulting mixture heated in an oil bath at 40° C. for 1 hour.

The mixture was then transferred to a centrifuge and spun at 1500 rpm for 1 hour. The reactor was cleaned with an acid wash to remove any unreacted lime and the supernatant liquid was transferred to a 3-necked flask and nitrogen passed through the mixture at 60 ml $min^{-1}$ with stirring at 400 rpm and heating to 55° C. Carbon dioxide was then passed through the mixture at 50 $ml.min^{-1}$ for 1 hour, and the mixture sparged with nitrogen as before. The mixture was heated for 30 minutes at 55° C. and then centrifuged at 1500 rpm for 60 minutes as before. The xylene (upper) phase was decanted into a 0.5 litre pear-shaped flask that contained 4.0 grams of a Group I base oil (XOMAPE150, obtained from ExxonMobil), the xylene, and any residual methanol and water, were stripped off at 125° C. in vacuo. The Basicity Index (BI) of the composition was measured as 1.23.

The salicylate was characterised by $^1$H NMR which showed that salicylate comprised of 50 mole % of the hydrocarb-1-yl salicylate, 20 mole % of hydrocarb-2-yl salicylate and 30 mole % of the salicylate comprised hydrocarb-3-yl, and higher hydrocarbyl substituted, salicylates.

Example 5

Preparation of 2-Pentadecanol

Pentadecanone (200 g) was added a 3-litre three-necked flask under nitrogen, to which diethyl ether (1000 ml) was slowly added from a dropping funnel. Sodium borohydride (63.54 g) was then slowly added and the mixture stirred for two days at room temperature under nitrogen. Toluene was added to the reaction vessel and the contents transferred to a separating funnel. The organic layer was washed with water and the aqueous layer was collected. The aqueous layer was washed with toluene, which was combined with the previous organic layer. The product was dried with magnesium sulphate and filtered under vacuum. The solvent was then stripped on a rotary evaporator at 100° C. to yield the title compound.

Example 6

Preparation of 2-Bromopentadecane

2-Pentadecanol of Example 5 (180 g) and dichloromethane (2500 ml) were added to a 5-litre three-necked flask. The mixture was cooled to 0° C., and carbon tetrabromide (313.6 g) was added and stirred until it dissolved. Triphenylphosphine (351.4 g) was then added dropwise. The resulting mixture was allowed to warm to ambient temperature and left stirring for two days. The reaction mixture was then filtered, and the solvent removed on a rotary evaporator at 56° C. The resulting solid was re-dissolved in heptane and left stirring for two days. It was then filtered through celite under vacuum, and the heptane removed on a rotary evaporator at 78° C. to yield the title compound.

Example 7

Preparation of 1-Methoxy-4-(pentadecyl-2-yl)benzene $FeCl_3$ (0.84 g) was poured quickly into a thoroughly dried 1 L 3-neck flask, to which THF (26 ml) and 2-bromopentadecane (Example 6, 30 g) were added. The reaction flask was then immersed in an ice/water bath. A mixture of N,N,N',N'-tetramethyletane-1,2-diamine (TMEDA, 17 ml) and (4-methoxyphenyl)magnesium bromide (0.5M in THF, 226.5 ml) was then added dropwise to the reaction mixture. 10% HCl was added to the reaction mixture slowly so as to minimise any exothern, followed by toluene. The contents of the reaction vessel were transferred to a separating funnel. The aqueous layer was washed with toluene and the toluene extracts were then combined, washed twice with brine, dried with $MgSO_4$ and the solvent removed in vacuo to give the title compound as a cream solid (30.45 g).

Example 8

Preparation of 4-(Pentadec-2-yl)phenol

The title compound was prepared from 1-methoxy-4-(pentadecyl-2-yl)benzene (Example 7, 30.33 g), tributylhexadecylphosphonium bromide (9.65 g) and HBr (48% aq., 53.9 ml) using the procedure of Example 2. The title compound was purified by column chromatography ($SiO_2$, toluene).

Example 9

Preparation of 2-Hydroxy-5-(pentadec-2-yl)benzoic acid

The title compound (24.89 g) was prepared from 4-(pentadec-2-yl)phenol (Example 8, 28.48 g) and NaOH (50% aq., 7.6 ml in the phenation step) using the procedure of Example 3.

Example 10

Preparation of Low Base Calcium 5-(Pentadec-2-yl)salicylate

The title compound in 4 g of base oil XOMAPE 150 (9.12 g, Basicity Index 1.21) was prepared as outlined in Example 4 by employing 5-(pentadecy-2-yl)salicylic acid (Example 9, 3.33 g), a commercial lower alkyl (i.e. less than $C_{20}$) salicylic acid (Infineum M7103, obtainable from Infineum UK Limited, 3.70 g), xylene (203.33 g), calcium hydroxide (1.56 g), and a promoter (methanol:water (97%:3%), 23.37 ml).

The salicylate was characterised by $^1$H NMR which showed that salicylate comprised of 0 mole % of the hydrocarb-1-yl salicylate, 70 mole % of hydrocarb-2-yl salicylate and 30 mole % of the salicylate comprised hydrocarb-3-yl, and higher hydrocarbyl substituted, salicylates.

Example 11

Preparation of Pentadecan-6-ol

A 500 ml three-necked round-bottomed flask was dried thoroughly. One port was blanked with a suba seal, one port was connected to an oil bubbler and one port was connected to a nitrogen supply. Nonanal (10 g) was added through the suba seal using a syringe, followed by THF (200 ml). The mixture was left to cool and stirred at 300 rpm whilst it was cooling. After cooling for 1 hour hexylmagnesium bromide (37 ml) was added through a syringe pump at 0.5 ml.min$^{-1}$. The mixture was allowed to warm up to room temperature and stirred under nitrogen for 4.5 hours, and then stirring discontinued and the reaction mixture left overnight. The mixture was transferred to a 1 litre separating funnel and heptane (100 ml) and 20% v/v HCL (50 ml) added. The layers were separated and the organic layer was washed with 3×50 ml of de-ionised water, dried over magnesium sulphate, filtered and the solvent removed in vacuo to yield the title compound (13.08 g).

Example 12

Preparation of 6-Bromo-pentadecane

The title compound (13.87 g) was prepared from Pentadecan-6-ol (Example 11, 12.65 g), carbon tetrabromide (22 g), triphenylphosphine (24.82 g) and dichloromethane (200 ml) using the procedure of Example 6.

Example 13

Preparation of 1-Methoxy-4-(pentadec-6-yl)benzene

The title compound (34.8 g) was prepared from 6-bromopentadecane (Example 12, 34 g), N,N,N',N'-tetramethyletane-1,2-diamine (14.92 g), THF (35 ml) and (4-methoxyphenyl)magnesium bromide (0.5M in THF, 226.5 ml) using the procedure of Example 7.

Example 14

Preparation of 4-(Pentadec-6-yl)phenol

The title compound (36.11 g) was prepared from 1-methoxy-4-(pentadec-6-yl)benzene (Example 13, 318 g), tributylpentadecylphosphonium bromide (413 g) and HBr (48% aq., 83.4 g) using the procedure of Example 2.

Example 15

Preparation of 2-Hydroxy-5-(pentadec-6-yl)benzoic acid

The title compound (10.8 g) was prepared from 4-(pentadec-6-yl)phenol (Example 14, 10 g) and NaOH (50% aq., 3.6 ml in the phenation step) using the procedure of Example 3.

Example 16

Preparation of Low Base Calcium 5-(Pentadec-6-yl)salicylate

The title compound in 4 g of base oil XOMAPE 150 (13.2 g, Basicity Index 1.48) was prepared as outlined in Example 4 by employing 5-(pentadecy-6-yl)salicylic acid (Example 15, 3.3 g), a commercial lower alkyl (i.e. less than $C_{20}$) salicylic acid (Infineum M7103, obtainable from Infineum UK Limited, 3.70 g), xylene (203 g), calcium hydroxide (4 g), and a promoter (methanol:water (97%:3%), 23.4 ml).

The salicylate was characterised by $^1$H NMR which showed that salicylate comprised of 0 mole % of the hydrocarb-1-yl salicylate, 20 mole % of hydrocarb-2-yl salicylate and 80 mole % of the salicylate comprised hydrocarb-3-yl, and higher hydrocarbyl substituted, salicylates.

Example 17

Preparation of 2-(dodocos-1-yl)phenol $Fe(acac)_3$ (iron acetylacetanto complex, 0.228 g) was weighed into a 100 mL 3-neck flask to which was added 1-bromododocosane (5.0 g), N-methyl pyrrolidinone (5.26 ml) and then THF (6 ml). The resulting solution was cooled to 0° C. and then a solution of the Grignard reagent (2-methoxyphenyl magnesium bromide (18.64 ml of a 1M solution in THF)) was added dropwise over two hours using a syringe pump. The reaction was allowed to stir overnight in an ice bath and then gradually warmed to room temperature. The contents of the reaction flask were then mixed with toluene and poured into a separating funnel. HCl solution (10% (v/v)) was then added to acidify the toluene. The upper toluene layer was then washed with water, the toluene filtered into a round-bottomed flask and the solvent stripped using a rotary evaporator.

HBr (0.82 mol, 54 mL) was added to a 1 litre 3-neck flask containing the anisole made in the previous step (30 g) and tributylhexadecylphosphonium bromide (9.65 g). The resulting stirred suspension was heated to 135° C. for 5 hours. The aqueous phase was extracted with toluene (2×100 ml), the combined toluene extracts were washed with brine (150 ml), dried with $MgSO_4$ and the solvent removed under vacuum to provide a brown solid. The resulting residue was purified by column chromatography ($SiO_2$, toluene) to afford the title compound as a solid.

Example 18

Preparation of 2-Hydroxy-3-(dodocos-1-yl)benzoic acid

The title compound was prepared from 2-(dodocos-1-yl)phenol (Example 17, 33.78 g) and NaOH (50% aq., 7.4 ml in the phenation step) using the procedure of Example 3.

Example 19

Preparation of Low Base Calcium 3-(dodocos-1-yl)salicylate

The title compound in 4 g of base oil XOMAPE 150 (Basicity Index 1.26) was prepared as outlined in Example 4 by employing 3-(dodocos-1-yl)salicylic acid (Example 18, 8.5 g), a commercial lower alkyl (i.e. less than $C_{20}$) salicylic acid (Infineum M7103, obtainable from Infineum UK Limited, 1.9 g), xylene (176.3 g), calcium hydroxide (2.87 g), and a promoter (methanol:water (97%:3%), 20.4 ml).

The salicylate was characterised by $^1$H NMR which showed that salicylate comprised of 80 mole % of the hydrocarb-1-yl salicylate, 12 mole % of hydrocarb-2-yl salicylate and 8 mole % of the salicylate comprised hydrocarb-3-yl, and higher hydrocarbyl substituted, salicylates.

Focused Beam Reflectance Method ('FBRM')

The alkaline earth metal salicylate detergents were tested for their asphaltene dispersancy using laser light scattering according to the Focused Beam Reflectance method ('FBRM'), which predicts asphaltene agglomeration and hence 'black sludge' formation. The FBRM test method was disclosed at the 7$^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on both Group I and Group II base stocks. The predictions of relative performance obtained from FBRM were confirmed by engine tests in marine diesel engines.

The FBRM probe contains fibre optic cables through which laser light travels to reach the probe tip. At the tip an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary. As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The respective alkaline earth metal salicylate detergents of (10% w/w) and Chevron 600 RLOP Group II base stock were blended together for fifteen minutes whilst heating to 60° C. and stirring at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically after 1 hour).

FBRM Test Results

| Example | Base Stock | C-1 attachment (mole %) | C-2 attachment (mole %) | C-3 and higher attachment (mole %) | Particle Counts, per sec |
|---|---|---|---|---|---|
| Comparative A (base stock only) | Chevron 600 RLOP | | | | 3345 |
| Salicylate of Example 4 | Chevron 600 RLOP | 50 | 20 | 30 | 266 |
| Salicylate of Example 10 | Chevron 600 RLOP | 0 | 70 | 30 | 297 |
| Salicylate of Example 19 | Chevron 600 RLOP | 80 | 12 | 8 | 65 |
| Comparative Salicylate of Example 16 | Chevron 600 RLOP | 0 | 20 | 80 | 2222 |
| Comparative Commercial Salicylate | Chevron 600 RLOP | 0 | 40 | 60 | 521 |

As shown in the Table above, the salicylate detergents of the present invention (Example 4, Example 10 and Example 19), where greater than 50 mole % of the salicylate detergent comprises a hydrocarby-1-yl substituted salicylate or a hydrocarb-2-yl substituted salicylate, exhibit substantially lower counts than the comparative salicylate of Example 16 and the commercial salicylate where greater than 50 mole % of the salicylate detergent comprises a hydrocarby-3-yl substituted, or higher hydrocarbyl substituted, salicylate. The average counts value is a function of both the average size and the level of agglomerate. Suitably, the salicylate detergents of the present invention are approximately at least eight times more efficient at dispersing asphaltenes than the comparative salicylate of Example 16 and approximately at least two times more efficient at dispersing asphaltenes than the commercial salicylate.

What is claimed is:

1. A detergent comprising one or more neutral or overbased alkaline earth metal $C_{10}$ to $C_{40}$ hydrocarbyl substituted hydroxybenzoates, wherein:

greater than or equal to 20 mole % of the one or more neutral or overbased alkaline earth metal $C_{10}$ to $C_{40}$ hydrocarbyl substituted hydroxybenzoates, based on the total number of moles of said neutral or overbased alkaline earth metal $C_{10}$ to $C_{40}$ hydrocarbyl substituted hydroxybenzoates, comprises one or more $C_{10}$ to $C_{40}$ hydrocarb-1-yl substituted hydroxybenzoates; or greater than or equal to 55 mole % of the one or more neutral or overbased alkaline earth metal $C_{10}$ to $C_{40}$ hydrocarbyl substituted hydroxybenzoates, based on the total number of moles of said neutral or overbased alkaline earth metal $C_{10}$ to $C_{40}$ hydrocarbyl substituted hydroxybenzoates, comprises one or more $C_{10}$ to $C_{40}$ hydrocarb-2-yl substituted hydroxybenzoates.

2. The detergent as claimed in claim 1, wherein greater than or equal to 55 mole % of said one or more $C_{10}$ to $C_{40}$ hydrocarbyl hydroxybenzoates, comprises one or more $C_{10}$ to $C_{40}$ hydrocarb-2-yl substituted hydroxybenzoates.

3. The detergent as claimed in claim 1, wherein greater than or equal to 20 mole % of said one or more $C_{10}$ to $C_{40}$ hydrocarbyl hydroxybenzoates, comprises one or more $C_{10}$ to $C_{40}$ hydrocarb-1-yl substituted hydroxybenzoates.

4. The detergent as claimed in claim 1, wherein less than or equal to 99 mole % of said one or more $C_{10}$ to $C_{40}$ hydrocarbyl hydroxybenzoates, comprises one or more $C_{10}$ to $C_{40}$ hydrocarb-1-yl substituted hydroxybenzoates.

5. The detergent as claimed in claim 1, wherein said $C_{10}$ to $C_{40}$ hydrocarbyl substituent of said one or more neutral or overbased alkaline earth metal $C_{10}$ to $C_{40}$ hydrocarbyl substituted hydroxybenzoates comprises a straight chain hydrocarbyl substituent.

6. The detergent as claimed in claim 1, wherein the one or more $C_{10}$ to $C_{40}$ hydrocarb-2-yl substituents of the one or more $C_{10}$ to $C_{40}$ hydrocarb-2-yl substituted hydroxybenzoates comprises one or more secondary straight chain $C_{10}$ to $C_{40}$ hydrocarbyl substituents.

7. The detergent as claimed in claim 1, wherein the one or more $C_{10}$ to $C_{40}$ hydrocarb-1-yl substituents of the one or more $C_{10}$ to $C_{40}$ hydrocarb-1-yl substituted hydroxybenzoates comprises one or more primary straight chain $C_{10}$ to $C_{40}$ hydrocarbyl substituents.

8. The detergent as claimed in claim 1, wherein said one or more neutral or overbased alkaline earth metal $C_{10}$ to $C_{40}$ hydrocarbyl substituted hydroxybenzoates comprises one or more neutral or overbased alkaline earth alkaline earth metal $C_{10}$ to $C_{20}$ hydrocarbyl substituted hydroxybenzoates.

9. The detergent as claimed in claim 1, wherein said one or more neutral or overbased alkaline earth metal $C_{10}$ to $C_{40}$ hydrocarbyl substituted hydroxybenzoates comprises one or more neutral or overbased alkaline earth metal $C_{20}$ to $C_{30}$ hydrocarbyl substituted hydroxybenzoates.

10. The detergent as claimed in claim 1, wherein said one or more neutral or overbased alkaline earth metal $C_{10}$ to $C_{40}$ hydrocarbyl substituted hydroxybenzoates comprises one or more neutral or overbased alkaline earth metal $C_{10}$ to $C_{40}$ hydrocarbyl mono-substituted hydroxybenzoates.

11. The detergent as claimed in claim 10, wherein said one or more neutral or overbased alkaline earth metal $C_{10}$ to $C_{40}$ hydrocarbyl mono-substituted hydroxybenzoates comprises one or more 3-mono-substituted $C_{10}$ to $C_{40}$ hydrocarbyl salicylates, one or more 5-mono-substituted $C_{10}$ to $C_{40}$ hydrocarbyl salicylates, or a mixture thereof.

12. The detergent as claimed in claim 1, wherein said one or more neutral or overbased alkaline earth metal $C_{10}$ to $C_{40}$ hydrocarbyl substituted hydroxybenzoates comprises one or more neutral or overbased alkaline earth metal $C_{10}$ to $C_{40}$ hydrocarbyl substituted salicylates.

13. The detergent as claimed in claim 1, wherein the alkaline earth metal is calcium.

14. A method of manufacturing a detergent as claimed in claim 1, the method comprising reacting one or more $C_{10}$ to $C_{40}$ hydrocarbyl substituted hydroxybenzoic acids with a metallic base and optionally with carbon dioxide, wherein:

greater than or equal to 20 mole % of the one or more neutral or overbased alkaline earth metal $C_{10}$ to $C_{40}$ hydrocarbyl substituted hydroxybenzoates, based on the total number of moles of said neutral or overbased alkaline earth metal $C_{10}$ to $C_{40}$ hydrocarbvl substituted hdroxybenzoates, comprises one or more $C_{10}$ to C40 hydrocarb-1-yl substituted hydroxybenzoates; or greater than or equal to 55 mole % of the one or more neutral or overbased alkaline earth metal $C_{10}$ to $C_{40}$ hydrocarbyl substituted hydroxybenzoates, based on the total number of moles of said neutral or overbased alkaline earth metal $C_{10}$ to $C_{40}$ hydrocarbyl substituted hydroxybenzoates, comprises one or more $C_{10}$ to $C_{40}$ hydrocarb-2-yl substituted hydroxybenzoates.

15. A compound comprising one or more $C_{10}$ to $C_{40}$ hydrocarbyl substituted hydroxybenzoic acids as defined in claim 14.

16. A method of manufacturing a compound as claimed in claim 15, the method comprising carboxylating one or more $C_{10}$ to $C_{40}$ hydrocarbyl substituted phenols, wherein:

greater than or equal to 20 mole % of the one or more $C_{10}$ to $C_{40}$ hydrocarbyl substituted phenols, based on the total number of moles of said one or more $C_{10}$ to $C_{40}$ hydrocarbyl substituted phenols, comprises one or more $C_{10}$ to $C_{40}$ hydrocarb-1-yl substituted phenols; or, greater than or equal to 55 mole % of the one or more $C_{10}$ to $C_{40}$ hydrocarbyl substituted phenols, based on the total number of moles of said one or more $C_{10}$ to $C_{40}$ hydrocarbyl substituted phenols, comprises one or more $C_{10}$ to $C_{40}$ hydrocarb-2-yl substituted phenols.

17. A lubricating oil composition comprising, or made by admixing:

an oil of lubricating viscosity; and, a detergent as claimed in claim 1.

18. A lubricating oil composition as claimed in claim 17 wherein the oil of lubricating viscosity is present in a concentrate forming amount.

19. A lubricating oil composition as claimed in claim 17 wherein the oil of lubricating viscosity is present in a major amount.

20. A lubricating oil composition as claimed in 17 wherein the oil of lubricating viscosity comprises a Group II base stock.

21. A lubricating oil composition as claimed in claim 17 wherein the detergent (B) is essentially the sole detergent present within the lubricating oil composition.

22. A lubricating oil composition as claimed in claim 17 wherein the lubricating oil composition is a trunk piston engine oil.

23. A lubricating oil composition as claimed in claim 17 further comprising one or more co-additives, other than the detergent (B), selected from friction modifiers, antiwear agents, dispersants, oxidation inhibitors, viscosity modifiers, pour point depressants, rust inhibitors, corrosion inhibitors, demulsifiers and foam control agents.

24. A method of reducing asphaltene precipitation (black paint) in an engine, the method including the step of lubricating the engine with a lubricating oil composition as claimed in claim 17.

* * * * *